US005378009A

United States Patent [19]

Dogat

[11] Patent Number: 5,378,009

[45] Date of Patent: Jan. 3, 1995

[54] SKI BINDING

[75] Inventor: Vincent Dogat, Annecy, France

[73] Assignee: Salomon S.A., Chavanod, France

[21] Appl. No.: 66,076

[22] PCT Filed: Oct. 11, 1991

[86] PCT No.: PCT/FR91/00791

§ 371 Date: May 17, 1993

§ 102(e) Date: May 17, 1993

[87] PCT Pub. No.: WO92/08527

PCT Pub. Date: May 29, 1992

[30] Foreign Application Priority Data

Oct. 15, 1990 [FR] France ..... 90 14342

[51] Int. Cl.[6] ..... A63C 9/08

[52] U.S. Cl. ..... 280/630; 280/632

[58] Field of Search ..... 280/626, 629, 630, 631, 280/632, 633, 634

[56] References Cited

U.S. PATENT DOCUMENTS

| | | | |
|---|---|---|---|
| 3,810,644 | 5/1974 | Beyl | 280/632 |
| 4,625,991 | 12/1986 | Friedrich | 280/632 |
| 4,792,157 | 12/1988 | Stritzl | 280/632 |
| 5,005,854 | 4/1991 | Szafranski | 280/632 X |

FOREIGN PATENT DOCUMENTS

| | | |
|---|---|---|
| 1474064 | 2/1967 | France . |
| 2236532 | 2/1975 | France . |
| 2243002 | 4/1975 | France . |
| 2610841 | 8/1988 | France . |
| 2633994 | 1/1990 | France . |
| 4021274 | 1/1991 | Germany . |

*Primary Examiner*—Mitchell J. Hill
*Assistant Examiner*—Michael Mar
*Attorney, Agent, or Firm*—Pollock, Vande Sande & Priddy

[57] ABSTRACT

Safety binding for an alpine ski, designed to hold a boot in place on a ski and to release this boot when it exerts excessive stress in the binding. The binding (1) comprises a base (3), a boot position-retention device (5), a return spring (10), a linkage comprising a piston (13) whose head (16) is fitted with two pressure tips (20, 21) and a unit comprising two rolling surfaces (23, 24) which connect the spring (10) and the jaw (5), each rolling surface being positioned opposite a pressure tip. The pressure tip 21 projects forward in relation to the pressure tip 20, and a dynamic damping arrangement is interposed between this pressure tip 21 and the body (14) of the piston (13).

10 Claims, 7 Drawing Sheets

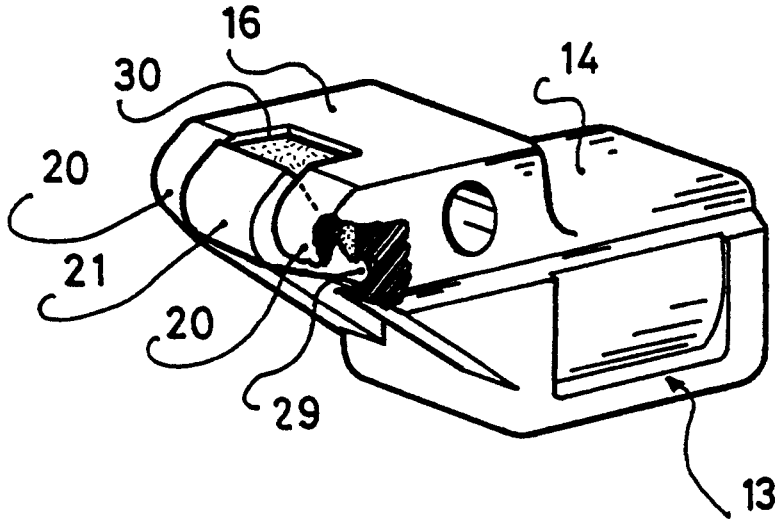
FIG: 4
FIG: 3
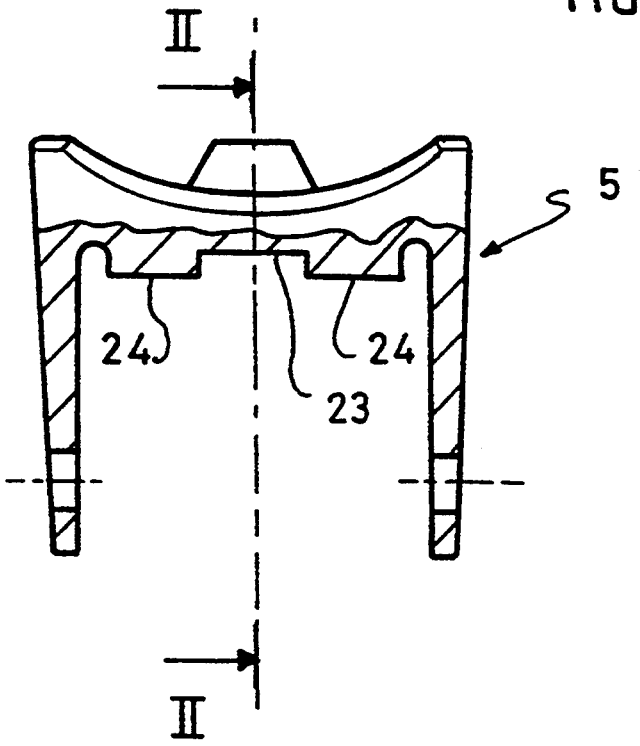

30
20
13
1
28
5
21
14
10
35

30
20
21
13
1
28
36
14
10

SKI BINDING

FIELD OF THE INVENTION

The invention concerns an alpine safety binding, designed to hold a boot in position on a sliding instrument, in particular a ski, and to release this boot when it exerts an excessive stress on the binding.

BACKGROUND OF THE INVENTION

Bindings of this kind are known, and they normally incorporate a base mounted on the sliding instrument and a boot position-retention device, which is mobile in relation to this base between a boot-retention and a boot-release position. This position-retention device is elastically returned to its position-retention position, normally by a compression spring which generates a return force that intensifies as the position-retention device moves away from its retention position, i.e., a force incorporating the intensity of the stress to which the boot subjects the boot-retention device.

When the stress exerted by the boot exceeds the maximum return force which the spring can transmit to the retention device, the boot is released. This maximum return force is ordinarily termed the "release threshold."

More specifically, the invention concerns safety bindings whose release threshold varies as a function of the speed and length of the stress. Thus, the release threshold is higher for a violent stress than for a mild one. It is known, in fact, that a skier's leg can withstand without damage a strong, brief stress. On the other hand, a stress of low intensity, but of long duration, may prove dangerous.

A device of this type is described, for example, in French Patent No. 2 610 841. This patent describes a damping device which functions in parallel on the spring, so as to generate an additional return force in the event of a violent stress.

The special feature of this patent lies in the fact that the additional return force is limited to a specified value in the event of a very violent stress, e.g., a shock.

The device described in this patent yields good results, but its construction is somewhat complex and bulky. In fact, it requires a hydraulic damping device, a jointed rocker which connects the damping device and one end of the spring, and a rocker-retention stop.

SUMMARY OF THE INVENTION

One of the purposes of the present invention is to propose a binding in which the return force of the position-retention device varies dynamically as a function of the speed of the stress, and which embodies, moreover, a simpler and less bulky construction.

Another purpose of the invention is to propose a binding for which the release threshold cannot exceed a specified value, even in the event of a very violent stress.

Other objectives and advantages of the invention will become apparent in the course of the following description, which is given, however, only for informational purposes.

The safety binding according to the invention comprises a base mounted on the ski, a position-retention device which is mobile in relation to the base between a position-retention position, in which it holds the boot in place on the ski, and a release position, in which it releases the boot, energy-generating means designed to engender an elastic return force which draws the retention device back to its retention position and which is variable as a function of the distance separating the retention device from its position-retention position, linkage means connecting the retention device and the energy-generating means, which exert stress on the energy-generating means according to the movements and the position of the position-retention device and which transmit back to the retention device the elastic return force generated by the energy-generating means.

The safety binding according to the invention is characterized by the fact that the linkage means comprise a mobile pressure element which the energy-generating means draw back elastically against a support mobile in relation to the pressure element and in conjunction with the movements of the position-retention device; by the fact that the pressure element has a head equipped with two pressure tips; that the support for the pressure element is an assembly incorporating two rolling surfaces; that each pressure tip is set opposite a rolling surface so as to constitute two distinct linkage elements between the energy-generating means and the position-retention device; that the components of one of the assemblies incorporating the rolling surfaces or pressure tips are integrally joined together, while the components of the other assembly are reciprocally mobile and connected by dynamic damping means, so that, in the event of a violent stress exerted by the boot, one of the linkage elements becomes functional; and that, in the event of a mild stress, the dynamic damping means retract and the other linkage element becomes operational.

According to a first embodiment of the invention, the binding is a rear binding, and the energy-generation mechanism with which it is fitted is a compression spring housed in the binding base. The position-retention device incorporates two rolling surfaces and the pressure means are constituted by a piston guided inside the base. Opposite the rolling surfaces, the piston has a pressure tip. The two pressure tips are mobile in relation to each other, one of the pressure tips is integrally attached to the body of the piston, and a block of damping material is interposed between the other pressure tip and the piston body.

According to a variant, the pressure element is a rocker.

According to an additional embodiment, the binding is a front binding, comprising a body mounted so as to be movable in rotation in relation to the base, and the pressure element is a piston guided in a sliding action in relation to the body and which is pushed backward by a spring against a support integrally attached to the base. The piston comprises two pressure tips, and the support comprises two rolling surfaces, each rolling surface being positioned opposite a pressure tip.

BRIEF DESCRIPTION OF THE DRAWINGS

Understanding of the invention will be enhanced by referring to the following description and to the attached drawings forming an integral part of it.

FIG. 3 is a top view in cross-section along line III—III of the jaw in FIG. 2.

FIG. 4 is a perspective view of the piston in FIG. 1.

DESCRIPTION OF THE PREFERRED EMBODIMENT

Figure 1:
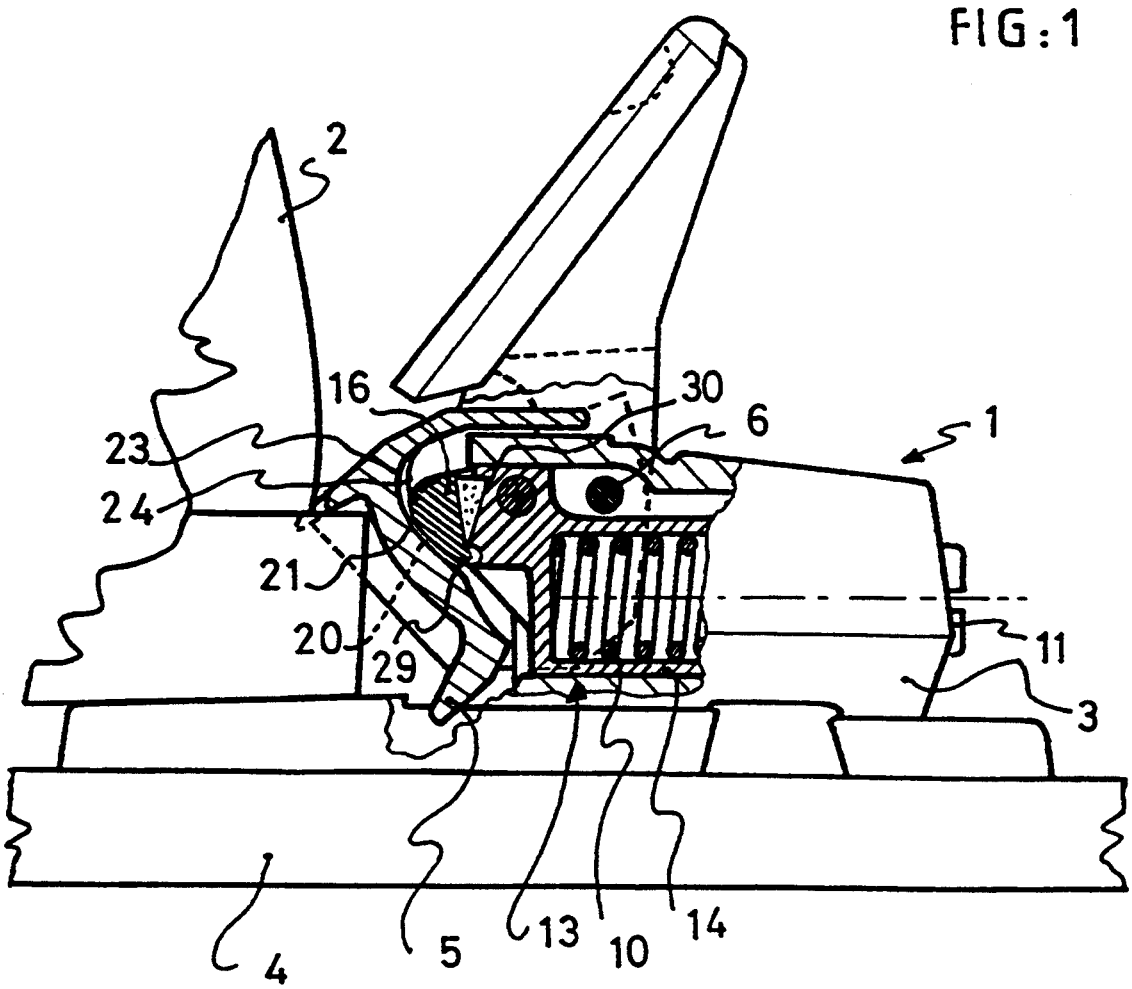
FIG. 1 is a side view in partial cross-section of a rear binding, illustrating a first non-limiting embodiment of the invention.

FIG. 1 is a diagrammatic representation of a binding 1 designed to hold in place the rear end of a boot, which is shown schematically at 2. The binding 1 comprises a base 3 mounted on a ski 4. The binding further comprises a jaw 5 jointed to the base 3 around a transverse, horizontal pin 6. This jaw 5 constitutes the device which holds the rear of the boot 2 in position.

Moreover, the binding 1 incorporates energy-generating means, here constituted by a compression spring 10 housed inside the base 3 and for which the initial pretensioning can be adjusted by a screw 11. The spring 10 is designed exert an elastic return force on the jaw 5.

Furthermore, linkage means connect the jaw 5 to the spring 10. In the present instance, these linkage means comprise a piston 13, which is guided in a housing in the base 3 when a sliding motion is produced in a direction parallel to the axis of the spring 10. The end of the spring 10 is supported against the body 14 of the piston 13, and it exerts on that body a forward-directed elastic return force.

The linkage mechanism further comprises a support integrally attached to the jaw 5, against which the spring 10 pushes the piston 13. The piston is supported against the support of the jaw 5 by means of a head 16 situated in its front part.

According to the embodiment illustrated in FIGS. 1 to 6, the head 16 of the piston 13 comprises two pressure tips 20 and 21, positioned side by side, the pressure tip 20 being made in two parts extending on either side of the pressure tip 21.

Opposite each pressure tip 20, 21, the jaw 5 comprises a rolling surface 23 intended for the pressure tip 21, and a rolling surface 24 intended for the pressure tip 20.

In conventional fashion, the rolling surfaces 23 and 24 comprise, respectively, an elastic arc of travel, 25 and 26 respectively, an arc for opening of the jaw 27, and an edge 28 common to these two arcs and corresponding to the binding-release threshold.

When the piston 13 describes an elastic arc of travel 25 or 26, the spring 10 generates an elastic return force drawing the jaw 5 back toward its position-retention position.

In conventional fashion, the compression of the spring 10, and thus the elastic return force of the jaw 5, intensifies as a function of the distance separating the position-retention device 5 from its retention position, as shown in FIG. 1.

After crossing the release threshold 28, the piston describes the arc of opening 27, and it generates on the jaw 5 an elastic return force drawing it toward its open position, in which the boot is not held in place by the jaw.

In the closed position of the jaw, i.e., the boot-retention position illustrated in FIG. 1 and in the absence of stress, the pressure tip 21 of the piston 13 projects forward in relation to the pressure tip 20. At the level of the jaw 5, the elastic arcs of travel 25 and 26 positioned opposite the pressure tips 21 and 20, are offset in the same way, so that the pressure tips 21 and 20 are in contact with the corresponding arcs 25 and 26, respectively. The elastic arc of travel 23 is thus offset toward the front in relation to the arc 26.

Figure 2:
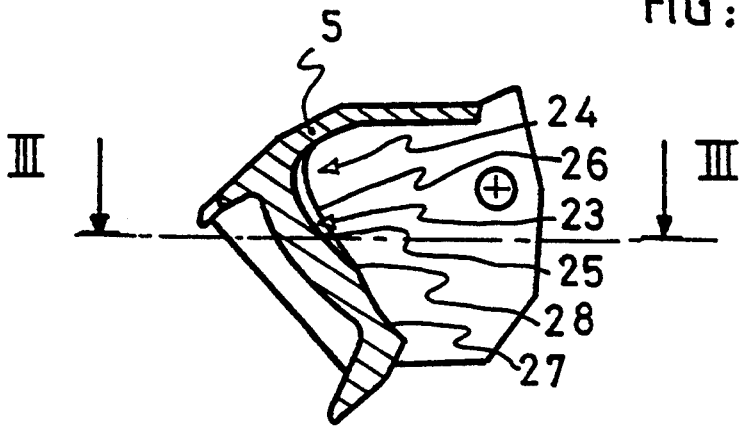
FIG. 2 is a side view in cross-section along line II—II of the jaw of the binding according to FIG. 1.

As shown in FIG. 2, the rolling surfaces 23 and 24 meet at the level of the release threshold 28 and exhibit a common profile at the level of arc of opening 27.

In the example illustrated, the two rolling surfaces 23 and 24 are integrally attached to the retention device 5 and are mutually immobile.

Figure 5:
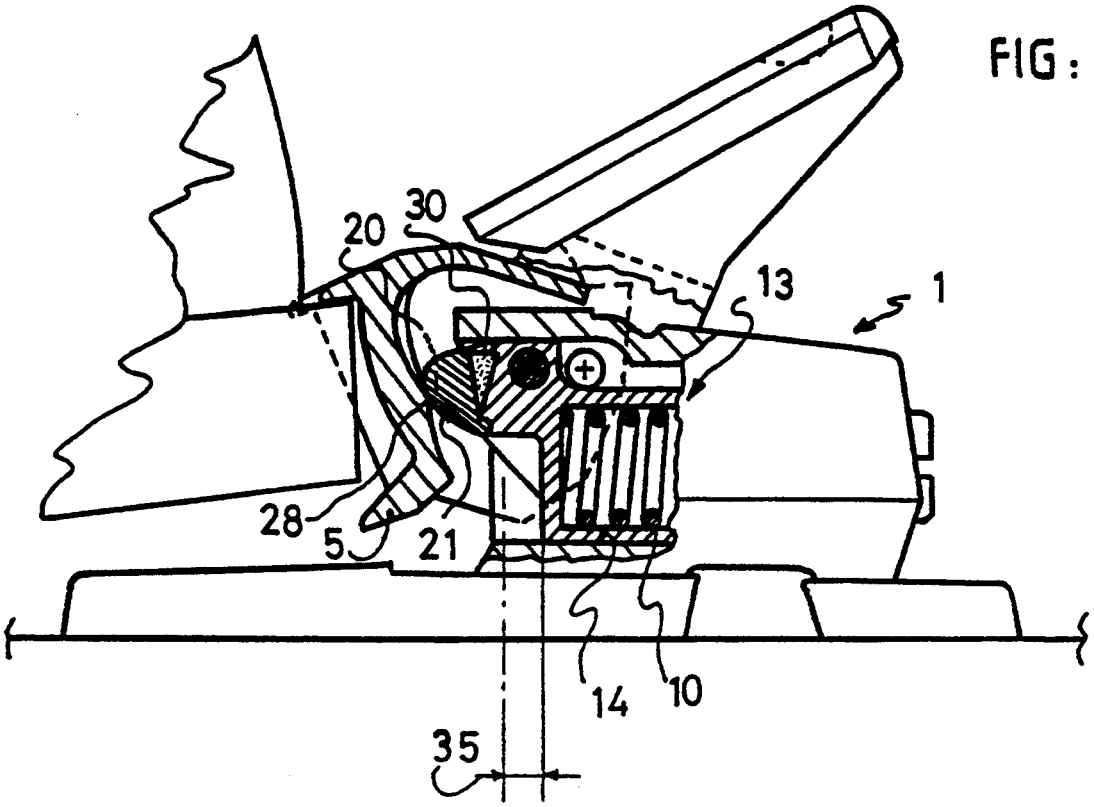
FIG. 5 illustrates the functioning of the binding in FIG. 1 in the event of a violent stress.
Figure 6:
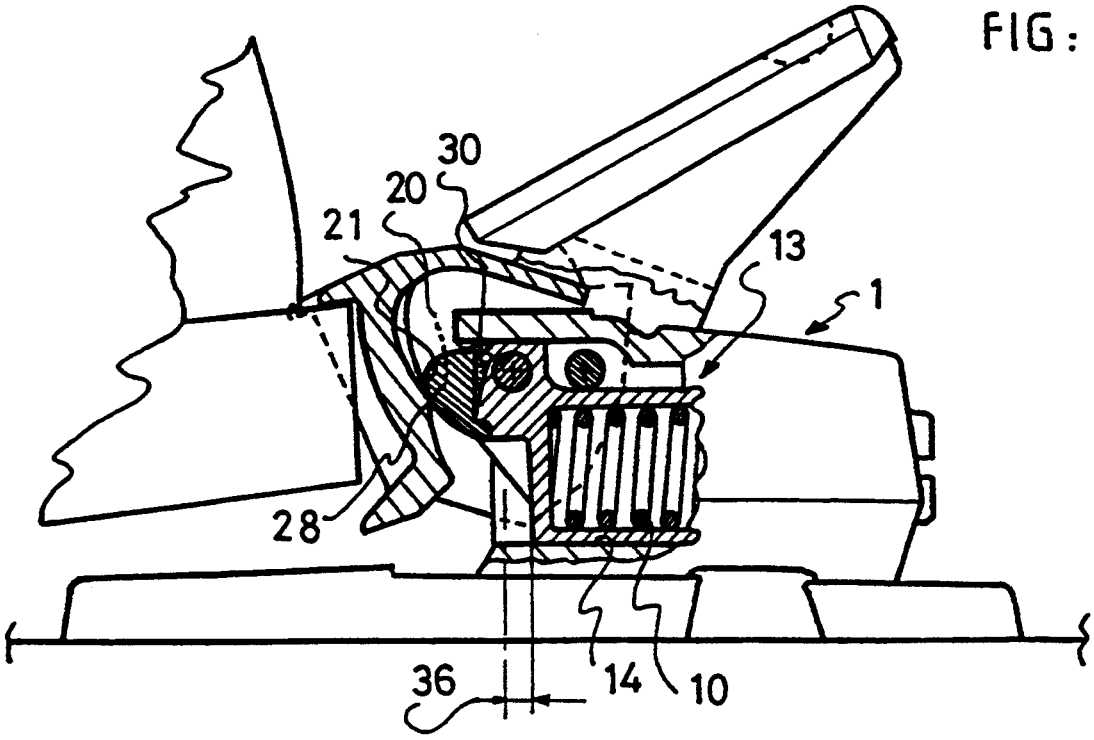
FIG. 6 illustrates the functioning of the binding in FIG. 1 in the event of a mild stress.

The pressure tip 20 is integrally connected to the body 14 of the piston 13. The pressure tip 21 is mobile in relation to the pressure tip 20 in a substantially longitudinal direction, and dynamic damping means are interposed between the pressure tip 21 and the body 14 of the piston 13. In the example in FIG. 1, the pressure tip 21 is connected to the head 16 of the piston 13 by a joint 29 positioned in its lower portion. The dynamic damping means are illustrated in FIGS. 4 to 6 as a block 30, e.g., a block of a viscoelastic material. In conventional fashion, this material possesses the property of elastic resistance to compression, which varies depending on the speed of the stress to which this material under compression is subjected.

As regards the viscoelastic material, materials marketed under the trade name "VIPTENE" (registered trademark) or "NEPURANE" (registered trademark), for example, are well known. Of course, any suitable material may be chosen, for example, from among thermoplastic materials, synthetic resins, silicone elastomers, rubbers, buthyl polychloroprenes, acrylic nitriles, ethylenes, propylenes, isomers, etc.

FIG. 1 illustrates the binding 1 in the jaw position-retention position, in the absence of stress. In this position, the two pressure tips 20 and 21 are positioned opposite each other and are in contact with their respective rolling surfaces and, more exactly, with their elastic arc of travel 26, 25. The block of material 30 is not stressed under compression, since the entire return force of the spring 10 is transmitted to the jaw by means of the pressure tip 20 and of the elastic arc of travel 26.

FIG. 5 represents a binding 1 on which the boot exerts a violent stress, e.g., a shock. In this case, the block of material 30 stiffens and the block 30 causes the pressure tip 21 to form virtually one piece with the body 14 of the piston 13. The pressure tip 21 thus cooperates with its elastic arc of travel 25, while the pressure tip 20 releases from its elastic arc of travel 26.

FIG. 5 illustrates the binding 1 at the time of disengagement, i.e., at the moment when the pressure tip 21 crosses the release threshold 28 of the jaw 5, so as to reach the arc of opening 27 corresponding to the opening of the jaw and to release of the boot.

Figure 7:
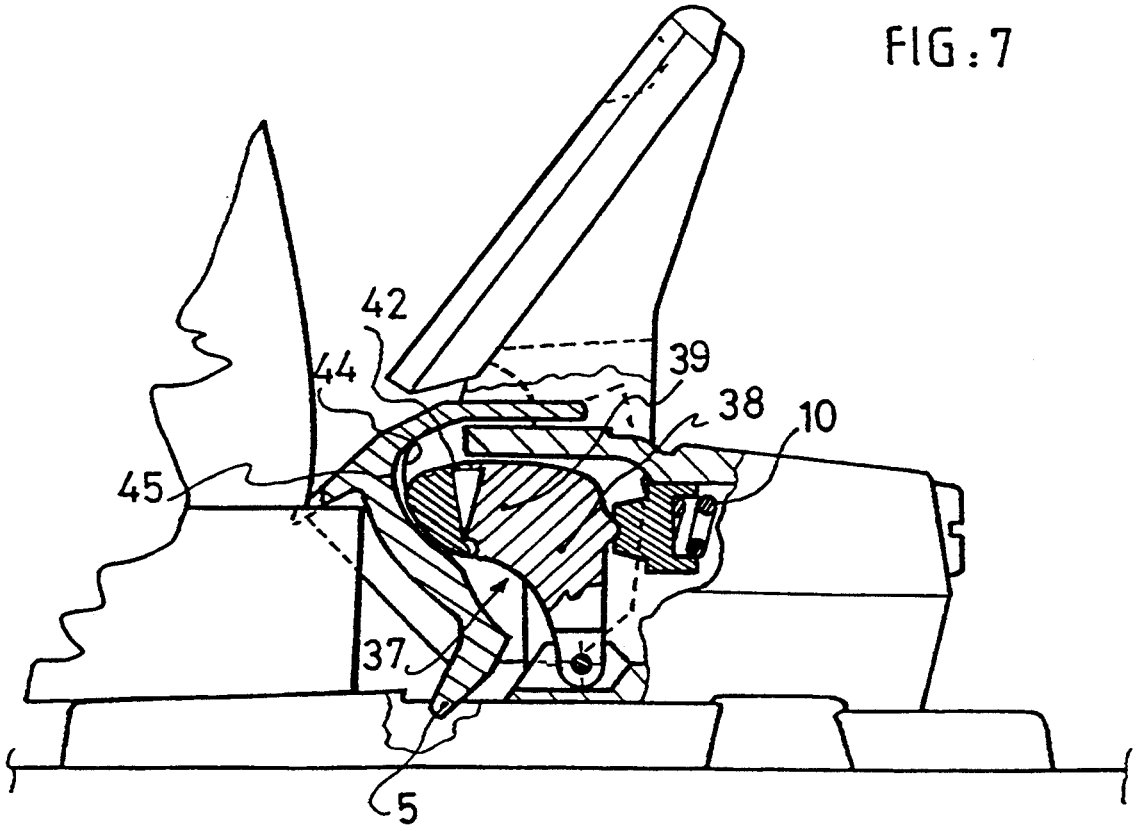
FIG. 7 is a variant of the binding in FIG. 1.

Reference 35 indicates diagrammatically the stroke of the piston 13; i.e., the distance which the piston 13 travels between the resting position in FIG. 1 and the release limit shown in FIG. 7. This stroke is equal to the distance by which the elastic arc of travel 25 has caused the piston 13 to move backward, by means of its pressure tip 21. The block 30 immobilizes, in fact, in this case the pressure tip 21 in its protruded position.

The stroke 35 corresponds to the compression of the spring 10, which, added to the initial compression of the spring, makes it possible to determine the force which returns the jaw to its retention position, and thus, the intensity of the stress to which the boot must subject the jaw in order to exceed the release threshold and to draw it into its open position.

FIG. 6 illustrates the binding 1, which is subjected to a mild stress exerted by the boot, for example, when the skier falls when stopped or travelling at low speed. As is apparent in the Figure, the block of material 30 is compressed by opposing a virtually zero resistance to the compression. Accordingly, it is the pressure tip 20 which cooperates with the elastic arc of travel 26. The pressure tip 21 remains in contact with the elastic arc of travel 25, but it does not ensure transmission of the stress between the rolling surface 23 and the piston 13, since the block 30 offers only very low resistance to compression.

FIG. 6 illustrates the binding at the time of its release, i.e., at the moment when the pressure tip 20 reaches the release threshold 28.

Reference 36 indicates diagrammatically the stroke of the piston 13; i.e., the distance travelled by the piston 13 from the position in FIG. 1 to the release threshold. In the present instance of a mild stress, the stroke 36 of the piston 13 is determined by the cooperation between the elastic arc of travel 26 and the pressure tip 20.

It is apparent that the stroke 36 is shorter than the stroke 35 in FIG. 5, which signifies that, in the case of a mild stress, the boot must overcome a jaw-return force which is weaker than that which the boot must overcome in the case of a violent stress, in order to reach the release threshold 28 and be disengaged.

In the example shown, the release threshold 28 and the arc of opening 27 are shared by the two pressure tips 20 and 21. Furthermore, in the case of a mild stress and at the moment of disengagement, the pressure tip 21 swivels rearward because of the compression of the material 30, until it becomes aligned with the pressure tip 20. This case is not restrictive, and the specialist could calculate different rolling surface profiles for the rolling surfaces 23 and 24, in particular at the edge 28 and the arc of opening 27.

Similarly, the specialist could reverse the functions of the rolling surfaces and pressure tips, and make the two rolling surfaces 25 and 26 mobile while being connected by dynamic linkage means, while the pressure tips would remain stationary in relation to each other.

Moreover, it must be emphasized that, in the case of a violent stress, when the pressure tip 21 has reached the disengagement edge 28 and then the arc of opening 27, given that the open position of the jaw is a stable position, the block of material 30 will end by being compressed, and, therefore, the spring 10 will slacken until the pressure tip 20 comes into contact with the arc of opening 27. In this way, whatever the type of stress having caused the jaw to open, the binding is in the jaw-open position, in the mild stress state, i.e., with the block 30 compressed and the pressure tip 20 supported against the arc of opening 27. The force which the boot must supply in order to close the jaw when the boot is put on again is reduced, since it is the pressure tip 20 which is functional.

Similarly, when the boot is voluntarily removed, the binding is in the mild stress configuration. In fact, the lever opens the jaw slowly. Accordingly, resistance to the opening of the jaw is determined by cooperation between the tip 20 and the arc 26.

It must be further noted that, in the event of shock, the increase in the return force which the boot must overcome to be released is advantageously limited, the additional force being determined by the distance separating the two pressure tips 20 and 21 in the resting position and the corresponding profile of the elastic arcs of travel 25 and 36.

Finally, the "mild" and "violent" stresses on which the explanations of FIGS. 6 and 5 were based are extreme cases. During skiing, the boot subjects the jaw to intermediate stresses. Nevertheless, the release threshold of the binding will always be greater than, or equal to, that corresponding to the minimum stroke 36 of the piston 19 (FIG. 6), and less than, or equal to, that corresponding to the maximum stroke 35 of the piston 13 (FIG. 5).

Figure 8:
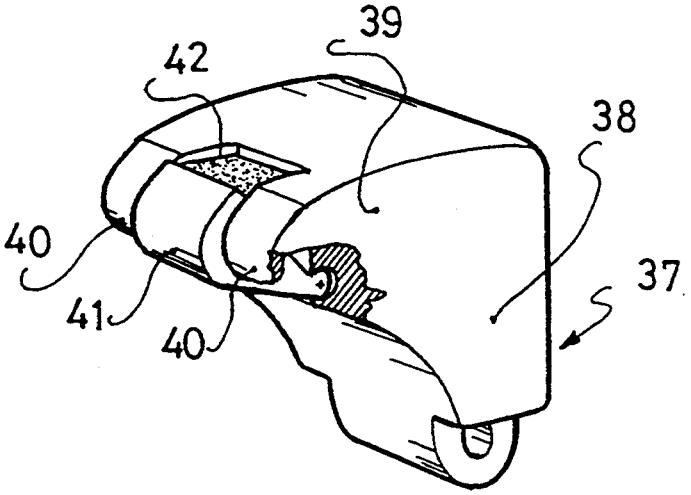
FIG. 8 is a perspective view of the rocker for which the variant in FIG. 7 is provided.

FIGS. 7 and 8 illustrate a variant in which the linkage mechanism connecting the spring 10 and the jaw 5 comprises a rocker 37 instead of the piston 13. The rocker 37 is jointed to the lower part of the base of the binding and comprises a body 38 and a head 39.

As in the preceding case, the head 39 has two pressure tips 40 and 41, the tip 41 projecting forward in relation to the pressure tip 40. The two pressure tips 40 and 41 are set opposite each other, respectively, and are, should the case arise, in contact with the two rolling surfaces 44 and 45 of the jaw, which are similar to the rolling surfaces 24 and 23 previously described. As in the preceding case, the two rolling surfaces 44 and 45 are immobile in relation to each other and are integrally attached to the jaw 5, the pressure tip 40 is integrally attached to the body 38 of the rocker 37, and the pressure tip 41 is mobile in relation to the pressure tip 40. Dynamic damping means, illustrated in the form of a block 42, are, moreover, interposed between the pressure tip 41 and the body 38. The block 42 is similar to the block 30 previously described.

The operation of the binding is similar to what has already been described with reference to the binding in FIG. 1.

Figure 10:
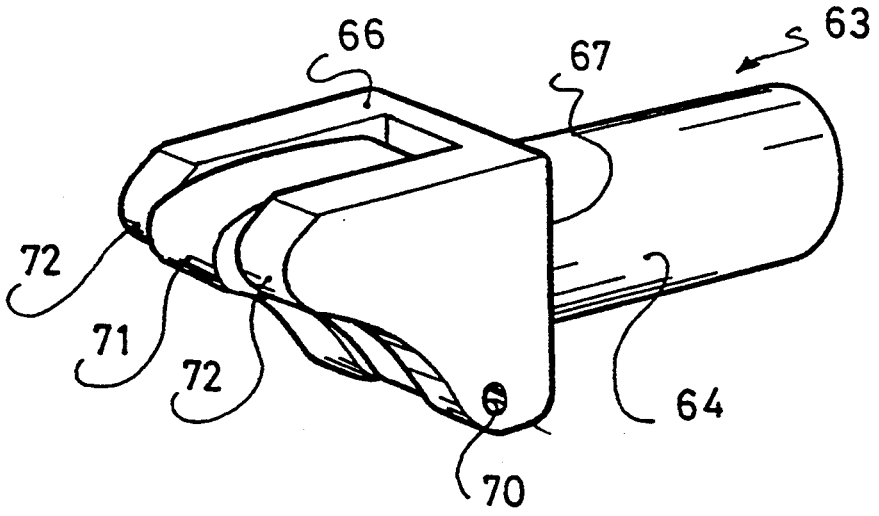
FIG. 10 is a perspective view of the piston for which a variant is provided in FIG. 9.
Figure 9:
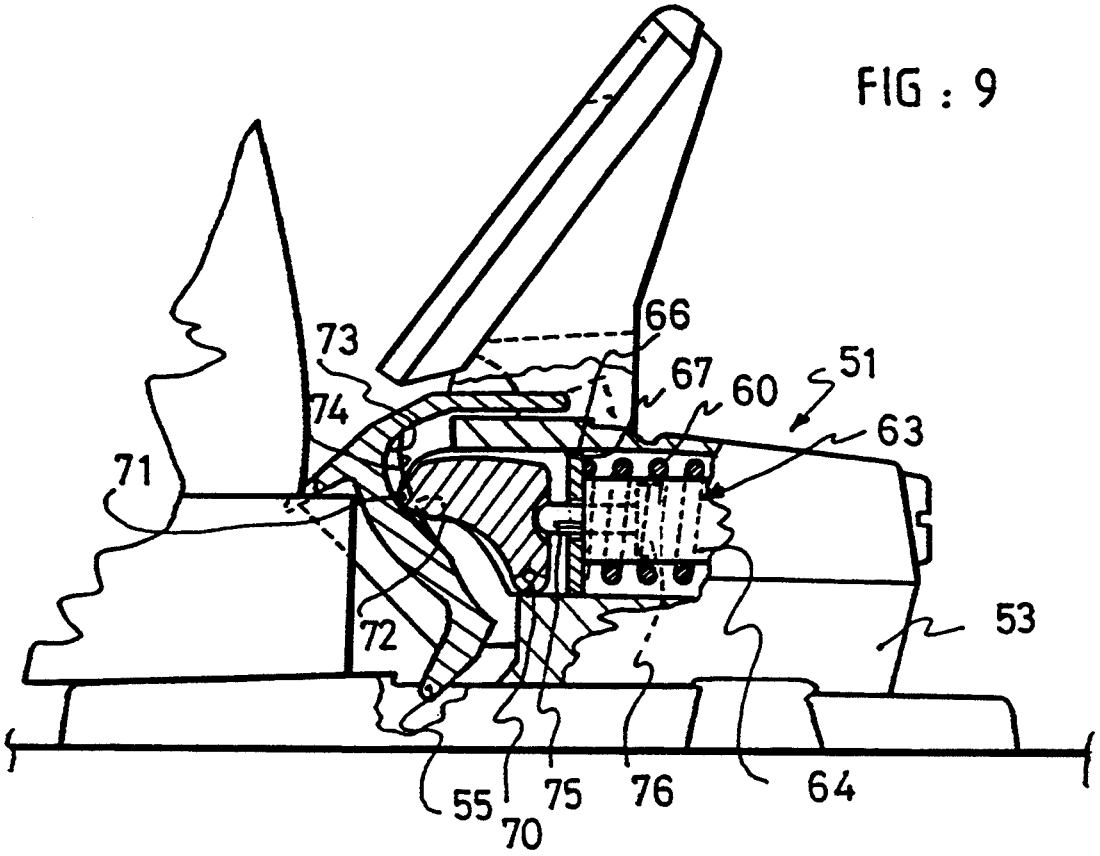
FIG. 9 is a view of another variant of the invention.

FIGS. 9 and 10 illustrate another variant of the invention, in which the dynamic damping means are constituted by a simple acting hydraulic damper, i.e., producing elastic return of the piston and of the shaft in the exit position, and, for example, by a damper of the same type as that described in French Patent Application No. 2 633 994, in Applicant's name.

Thus, FIG. 9 shows a rear binding 51, the base 53 mounted on the ski, and a jaw 55 mounted on the base 53 and drawn back elastically by a spring 60 into the retention position.

As in the case shown in FIG. 1, the means for linking the spring and the jaw take the form of a piston supported on a rolling surface. However, in the present case, the entirety of the damper 63 constitutes the piston and is guided in relation to the base 53 so as to produce a sliding motion in a direction parallel to the axis of the spring 60. The body 64 of the damper 63 is advantageously cylindrical and generated by revolution, and its diameter is substantially smaller than the inner diameter of the turns of the spring, so as to be engaged inside the turns at the front end of the spring. Furthermore, the body 64 incorporates, in its front part, a head 66 which, in relation to the body 63, forms a shoulder 67, against which the front end of the spring 60 comes to be supported.

As in the preceding cases, the front portion of the head 66 has two pressure tips, a central pressure tip 71 and a pressure tip 72 which overlaps the tip 71. The central tip 71 projects forward in relation to the tip 72.

The pressure tip 72 is integrally connected to the head 66 and to the body 64 of the damper. On the other hand, the pressure tip 71 is mobile in relation to the pressure tip 72, and is connected to the shaft and to the inner piston of the damper 63. These elements have been represented schematically at 75 and 76 in FIG. 11. For example, the lower part of the pressure tip 71 is jointed to the head 66 of the damper around a pin 70, and its rear portion rests against the shaft 75 of the damper.

As in the preceding cases, the jaw 55 incorporates, opposite each of the pressure tips 71 and 72, a rolling surface 73 and 74. The profile of the rolling surfaces 73 and 74 is similar to that of the preceding rolling surfaces 23 and 24. Moreover, the operation of the binding 51 is similar to that of the binding in FIG. 1, except for the fact that it is the hydraulic mechanism which ensures the damping action, instead of the viscoelastic means.

Figure 11:
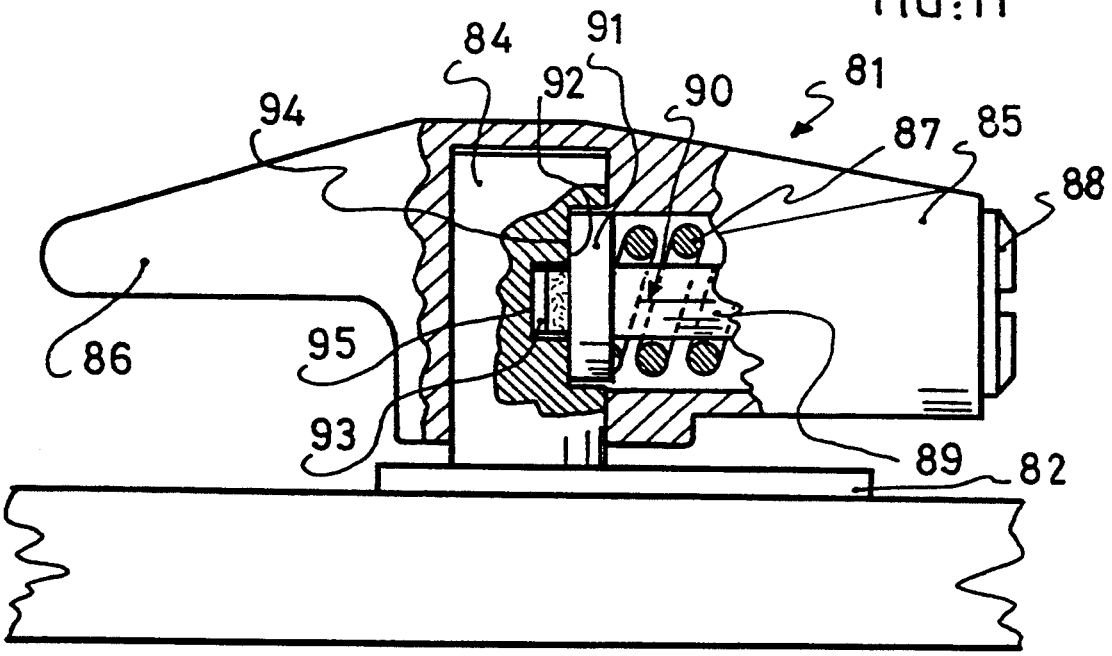
FIG. 11 is a side view in partial cross-section of a front binding according to another non-limiting embodiment of the invention.
Figure 14:
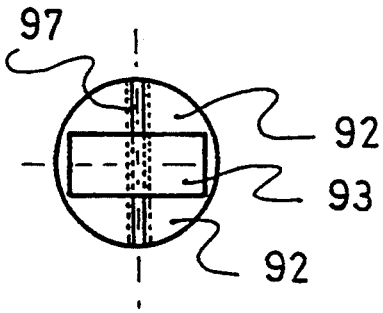
FIG. 14 is a front view of the piston in FIG. 13.
Figure 15:
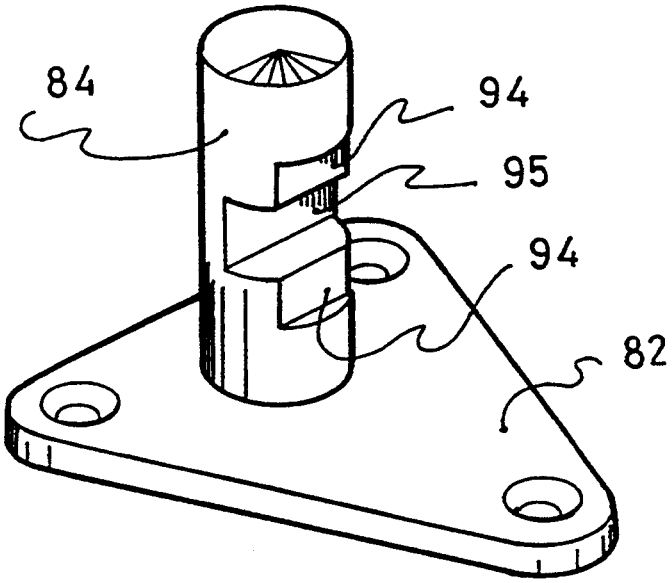
FIG. 15 is a perspective view of the pivot equipping the binding in FIG. 11.

FIGS. 11 and 12 to 15 illustrate another embodiment of the invention, as applied to a front binding. Accordingly, FIG. 11 illustrates a front binding 81 comprising a base 82 mounted on the ski 83 and a pivot 84 integrally attached to the base 82. The binding 81 further comprises a body 85 with a jaw 86 for holding the boot. The body 85 is jointed in rotation in relation to the pivot 84 and against the return force generated by a spring 87. The spring 87 rests, on one side, against an adjustment plug screwed into the body, and, on the other, against the pivot 84 by means of a piston 90 having a body 89 engaged in the spring 87. On the pivot side 84, the piston 90 has a head 91 equipped with two pressure tips 92 and 93. As illustrated in FIG. 14 in front view, the head 91 of the piston 90 is disk-shaped. The pressure tip 93 is constituted by a central, horizontal portion of this disk, while the pressure tip 92 is constituted by the upper and lower portions of this disk.

The pivot 84 incorporates a rolling surface 94 and 95, respectively, set opposite each of the pressure tips 92 and 93. The rolling surfaces 94 and 95 are, in fact, formed from flat surfaces which the pivot 84 positions facing each of the pressure tips. The rolling surface 95 is set back from the rolling surface 94, so that, in the centered position of the body 85 and in the absence of stress, each of the pressure tips 92 and 93 is in contact with the rolling surface 94, 95. It must be emphasized that the relative position of the rolling surfaces 92 and 93 creates a configuration in which, horizontally and transversely, the rolling surface 94 has a dimension smaller than that of the rolling surface 95. As a result, the cooperation between the pressure tip 93 and this rolling surface 94 will generate a return force stronger than the contact between the tip 92 and the rolling surface 95.

In the piston, the head 92 is integrally attached to the body of the piston 91. On the other hand, the head 93 is mobile relative to the head 92, and dynamic damping means are interposed between the head 93 and the body 89.

Figure 12:
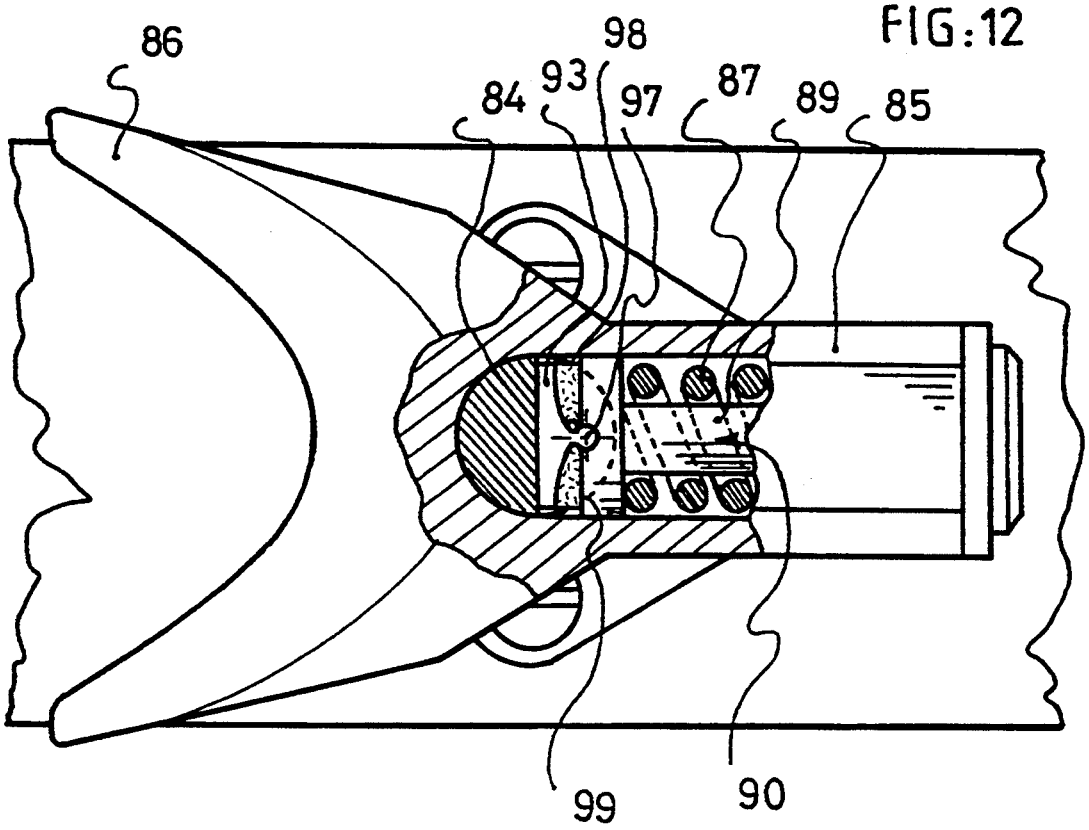
FIG. 12 is a top view in partial cross-section of the binding in FIG. 13.
Figure 13:
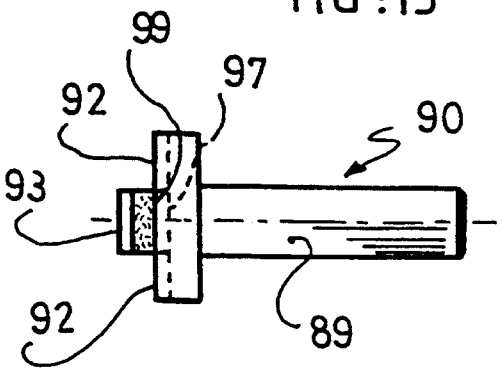
FIG. 13 is a side view of the piston equipping the binding in FIG. 11.

As illustrated in FIG. 12, for example, the pressure tip 93 can swivel in relation to the body 91 around a central, vertical edge 97, and blocks of a damping material, e.g., a viscoelastic material, are arranged on either side of the edge 97 so as to fill in the gaps between the pressure tip 93 and the rest of the piston.

The binding specified in the present variation behaves similarly to the bindings previously described, with the exception of the fact that, in the present instance, one or the other of the blocks 98 or 99 is stressed under compression in the direction in which the body 85 is driven by the boot.

Therefore, in the event of a violent stress, the block 98 or 99 subjected to stress stiffens, and it is the pressure tip 93 which, in conjunction with the rolling surface 95, produces displacement of the piston 90, and thus, compression of the spring.

On the other hand, in the event of a mild stress, the block 98 or 99 subjected to stress opposes only a very low level of resistance to compression, and it is the pressure tip 92 which, in conjunction with the rolling surface 94, causes displacement of the piston, and thus compression of the spring. Considering the relative position and the widths of the rolling surfaces 94 and 95, it is known that the compression of the spring will be weaker in the case in which compression is generated by the pressure tip 92 than in the case in which it is generated by the pressure tip 93. Thus, the force that the boot must overcome to be released will be weaker in the case of a mild stress than in the case of a violent stress.

Of course, the present description is provided only for informational purposes, and other embodiments could be adopted while remaining within the scope of that description.

What is claimed is:

1. Alpine ski safety binding designed to hold a boot in place on a ski and to release this boot when the latter exerts excessive stress on the binding, comprising:

a base (3, 53, 82) mounted on the ski, a boot-retention device (5, 55, 86) for holding the boot in position which is movable in relation to said base (3, 53, 82) between a boot-retention position in which said device holds the boot on the ski and a release position in which said device release the boot, spring means (10, 60, 87) designed to generate an elastic return force drawing said boot retention device (5, 55, 86) back toward its boot-retention position, said force being variable as a function of the distance separating the position of the boot-retention device from its boot-retention position, and linkage means between said boot-retention device and said spring means, which imposes stress on said spring means (10, 60, 87) in accordance with the movements and the position of said boot-retention device (5, 55, 86) and which retransmit back to said boot-retention device said elastic return force generated by said spring means, wherein said linkage means comprise a movable pressure element (13, 37, 63, 90) drawn elastically back by said spring means (10, 60, 87) against a support which is movable in relation to said pressure element in accordance with the movements of the boot-retention device; said pressure element (13, 37, 63, 90) incorporates a head equipped with two pressure tips (20/21, 40/41, 72/71, 92/93); said support of said pressure element is an assembly incorporating two rolling surfaces (24/23, 44/45. 74/73, 94/95); each pressure tip being positioned opposite a rolling surface so as to form two distinct linkage elements between said spring means and said boot-retention device, and components of one of said assembly incorporating said rolling surfaces and said pressure tips (20/21, 40/41, 72/71, 92/93) are integrally connected to each other, while components of the other one of said assembly incorporating said rolling surfaces and said pressure tips are movable in relation to each other and connected by dynamic damping means (30, 42, 63, 98–99), whereby, in the event the boot is subjected to a violent stress, one of the linkage elements becomes functional, and, in the event of a mild stress, the dynamic damping means retract and the other linkage element becomes functional.

2. Binding according to claim 1, wherein one of said pressure tips (21, 41, 71, 93) protrudes forward in relation to said other pressure tip (20, 40, 72, 94).

3. Binding according to claim 2, wherein the rolling surface (23, 45, 73, 95) positioned opposite said protruding pressure tip (21, 41, 71, 93) is at least partially set back in relation to said other rolling surface (24, 44, 74, 94), which is positioned facing said other pressure tip (20, 40, 70, 94).

4. Binding according to claim 2, wherein said dynamic damping means take the form of at least one block (30, 42, 98, 99) of a viscoelastic material interposed between said projecting pressure tip (21, 41, 93) and the body (14, 38, 89) of said pressure element (13, 37, 90).

5. Binding according to claim 2, wherein said dynamic damping means are a hydraulic damper (63) and said forward-projecting pressure tip (71) is connected to the shaft (75) and the inner piston (76) of said damper (63).

6. Binding according to claim 2, wherein said pressure element is a piston (13), one of said pressure (20) tips is integrally attached to said body (14) of said piston (13), and said other pressure tip (21) is supported against said body (14) of said piston (13) by means of a block (30) of viscoelastic material.

7. Binding according to claim 4, wherein said pressure element is a rocker (37) jointed in rotation to the base of said binding, one of said pressure tips (40) is integrally attached to the body (38) of said rocker (37) and said other pressure tip (41) is supported against the body (38) of said rocker (37) by means of a block (42) of viscoelastic material.

8. Binding according to claim 5, wherein said pressure element is equipped with a damper (63) whose head (66) is guided in a sliding motion in relation to the binding body (53) in a direction parallel to the axis of said spring, one of the pressure tips (72) is integrally attached to the body (64) of said damper, and said other pressure tip (71) is connected to said shaft (73) and piston (74) of said damper.

9. Binding according to claim 1, wherein said pressure element comprises a shaft (90) whose head (91) is disk-shaped, said projecting pressure tip (93) is a central, horizontal portion of said disk, said other pressure tip (92) is formed from the upper and lower portions of said disk, and said dynamic damping means are two blocks (98, 99) of viscoelastic material interposed between said projecting pressure tip (93) and the head of said shaft (90).

10. Binding according to claim 9, wherein said projecting pressure tip (93) is supported on the head (89) of said shaft (90) by a central, vertical edge (97), and said blocks (98) and (99) of viscoelastic material are positioned on either side of said edge.

* * * * *

UNITED STATES PATENT AND TRADEMARK OFFICE

CERTIFICATE OF CORRECTION

PATENT NO. : 5,378,009

DATED : January 3, 1995

INVENTOR(S) : Dogat

It is certified that error appears in the above-indentified patent and that said Letters Patent is hereby corrected as shown below:

On title page, item [30], foreign application priority data contains an error in the printing of the French application filing date: delete "Oct. 15, 1990" in favor of --Nov. 15, 1990--.

Signed and Sealed this

Sixteenth Day of May, 1995

*Attest:*

*Attesting Officer*

Bruce Lehman

BRUCE LEHMAN

*Commissioner of Patents and Trademarks*